US011661873B2

(12) United States Patent
Dooley

(10) Patent No.: US 11,661,873 B2
(45) Date of Patent: May 30, 2023

(54) COMPACT SLIP-IN SPARK ARRESTOR

(71) Applicant: Bret Allen Dooley, Prescott, AZ (US)

(72) Inventor: Bret Allen Dooley, Prescott, AZ (US)

(73) Assignee: Bret A. Dooley, Prescott, AZ (US)

( * ) Notice: Subject to any disclaimer, the term of this patent is extended or adjusted under 35 U.S.C. 154(b) by 0 days.

(21) Appl. No.: 17/938,606

(22) Filed: Oct. 6, 2022

(65) Prior Publication Data

US 2023/0128285 A1 Apr. 27, 2023

Related U.S. Application Data

(60) Provisional application No. 63/271,858, filed on Oct. 26, 2021.

(51) Int. Cl.
*F01N 3/06* (2006.01)
*F01N 3/037* (2006.01)

(52) U.S. Cl.
CPC ..... *F01N 3/06* (2013.01); *F01N 3/037* (2013.01); *F01N 2230/06* (2013.01)

(58) Field of Classification Search
CPC ..... B01D 45/16; F01N 1/085; F01N 1/086; F01N 3/037; F01N 3/06; F01N 13/082; F01N 13/20; F01N 2260/06; F01N 2230/06; F01N 2470/30
See application file for complete search history.

(56) References Cited

U.S. PATENT DOCUMENTS 2,403,403 A * 7/1946 Urban ..... F01N 1/084 181/274
5,161,371 A * 11/1992 Deville ..... F01N 3/005 60/309
6,470,998 B1 * 10/2002 White ..... F01N 3/06 181/239
8,671,671 B1 * 3/2014 Spencer-Smith ..... F01N 13/082 60/324
2007/0012511 A1 * 1/2007 Wall ..... F01N 13/1872 181/278

FOREIGN PATENT DOCUMENTS

DE 2843854 A1 * 4/1980
FR 2790788 A1 * 9/2000 ..... F01N 1/04
KR 102104213 B1 * 5/2020
WO WO-02053884 A2 * 7/2002 ..... F01N 1/18

* cited by examiner

*Primary Examiner* — Jonathan R Matthias

(57) ABSTRACT

A compact slip-in spark arrester having an interior shell (125) with a circular cross-section changing in diameter along its axial length which is axially aligned between an inlet cap member (115) and an outlet cap member (145). The tubular center section (130) of the interior shell (125) containing a centrifugal whirling means to remove any particulate matter from the exhaust flow by means of centrifugal force or deflection and trapping the particulate matter in an outer chamber (155) between the interior shell (125) and existing silencer shell (100).

10 Claims, 4 Drawing Sheets

COMPACT SLIP-IN SPARK ARRESTOR

CROSS-REFERENCE TO RELATED APPLICATIONS

Figure 1:
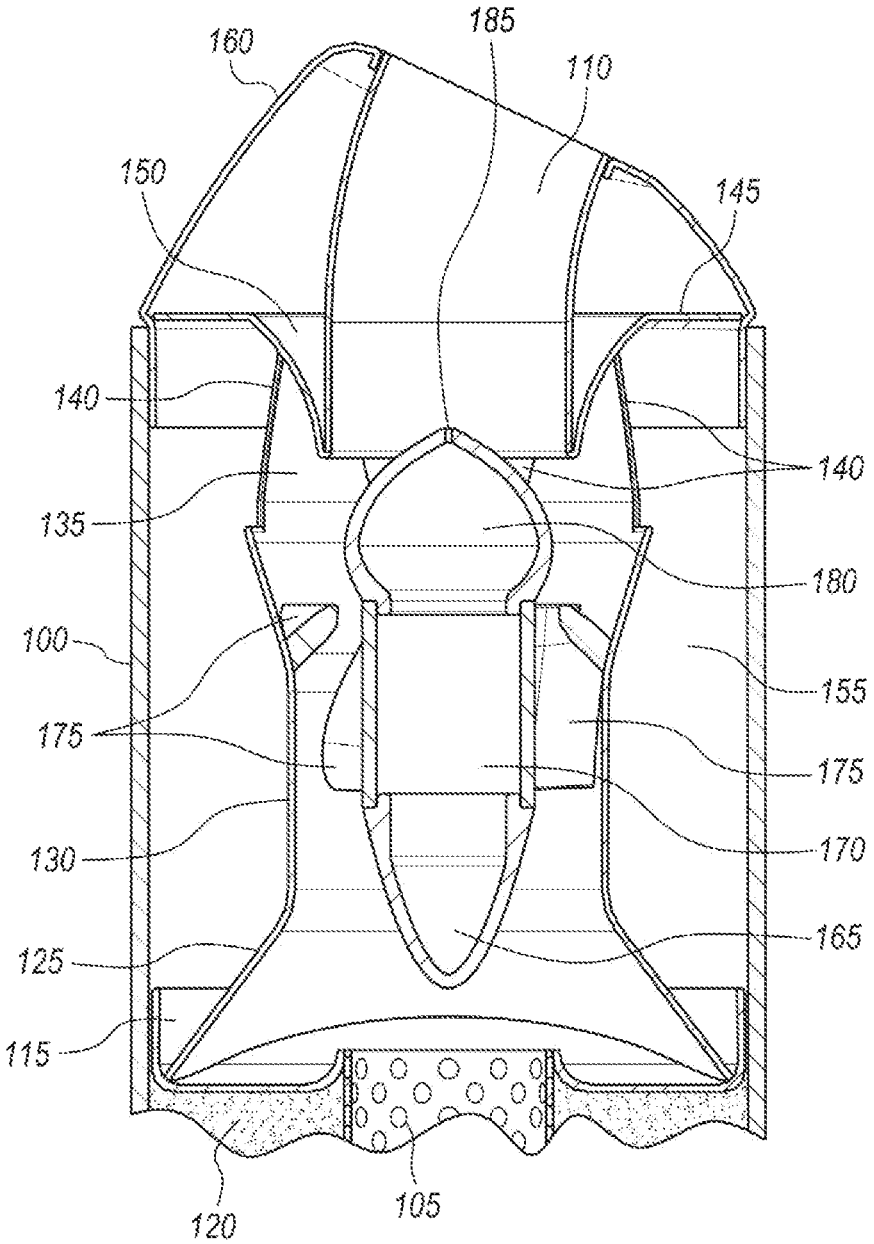

This application claims the benefit of provisional patent application Ser. No. 63/271,858, filed 2021 Oct. 26 by the present inventor.

PRIOR ART

The following is a tabulation of some prior art that presently appears relevant:

| U.S. Patents | | | |
|---|---|---|---|
| Pat. No. | Kind Code | Issue Date | Patentee |
| 5,509,947 | A | 1996 Apr. 23 | Burton |
| 3,757,892 | A | 1973 Sep. 11 | Raudman, Jr. |
| 3,407,575 | A | 1968 Oct. 29 | Krizman |
| 3,009,539 | A | 1961 Nov. 21 | Papp |

| Foreign Patents | | | | |
|---|---|---|---|---|
| Foreign Doc. Nr. | Cntry Code | Kind Code | Pub./Issue Dt | Patentee |
| 404,722 | AU | A | 1968 Feb. 1 | Davis et al. |
| 455,032 | CA | A | 1949 Mar. 8 | Bourne et al. |

BACKGROUND

This invention relates to internal combustion engine exhaust systems for off-road vehicles (ORVs) such as motorcycles, three and four wheel all-terrain vehicles (ATVs), side by side or utility task vehicles (UTVs), two and four wheel drive off-road automobiles and trucks, any of which could have the disclosed invention applied to their exhaust systems, however; for the purposed of discussion, will be described specifically for motorcycles.

Currently in the U.S.A. it is required for all federal public lands, in addition to most state and locally owned lands used by the public, that internal combustion engines operated on said lands must possess a functional spark arresting device on the exhaust system to prevent emission of hot sparks in the form of particulate matter or debris such as carbon particles that may start fires. The arresting efficiency of these spark arrestors is tested by measuring the percent of carbon particles retained or destroyed by the spark arrestor under test conditions described by the United States Forest Service (USFS) and Society of Automotive Engineers (SAE), with a passing arresting efficiency of 80% or greater.

The two classifications of spark arrestors for small engines as described by the USFS include:

Centrifugal type: A type of spark arrestor that uses baffles, traps, and/or vanes, to remove particulate matter from exhaust flows.

Screen type: A type of spark arrestor which uses a screen mesh to trap particulate matter.

Spark arrestors are typically mounted downstream in the exhaust flow just prior to the exhaust exit and traditionally for motorcycles attached to the end of or internal to the silencer, which is the last component of the exhaust system and functions to attenuate the exhaust noise. Because the spark arrestor is placed inside of the silencer, the size is critical and preferred to be as small as possible so that more of the overall silencer volume may be utilized to perform its primary function of attenuating the exhaust noise. If a spark arrestor is too long and takes up too much of the allocated silencer volume, the resulting exhaust system can be too loud to meet maximum sound restrictions, specifically the 96 decibel maximum as defined by the USFS for off-highway vehicles.

The primary design challenge for a spark arrestor is to meet the 80% arresting efficiency requirement while imparting a minimal change to exhaust flow rate. This is a significant design challenge because the two factors of exhaust flow rate and spark arresting efficiency are fundamentally competing mechanisms such that as the spark arrestor design is modified to increase arresting efficiency there is classically a reduction of exhaust flow rate that accompanies this improvement. Specifically for screen type spark arrestors: the addition of a screen mesh to the exhaust flow path disrupts laminar flow which increases back pressure and creates a significant reduction in exhaust flow rate. Additionally, as the screen becomes clogged with particulate matter, back pressure is further increased as the available flow path area is reduced and the reduction in exhaust flow rate compounded until the screen is removed and cleaned. Compared to screen type spark arrestors, centrifugal type spark arrestors typically have less of an effect on exhaust flow rate and do not become clogged because the particulate matter is removed from and trapped outside of the flow path. The increased back pressure and associated flow rate reduction created by centrifugal type spark arrestors is a result of turbulent flow disorders caused by the addition of flow path directors such as fins and annular chambers which serve to accelerate flow, change flow direction, divert, and then trap the exhaust particulate matter. Typically as more flow path directors are added to the system, arresting efficiency goes up along with the number of turbulent flow disorders which causes an increase in back pressure and decrease in exhaust flow rate.

Specifically for motorcycle engines, the current state of the art screen and centrifugal spark arresting devices meeting the 80% arresting efficiency requirement produce roughly a 25-55% change in flow rate for a given back pressure. The 25-55% change in flow rate reduces the engines volumetric efficiency and hence performance. Historically this decrease in engine performance has been accepted as a necessary compromise to meet the 80% arresting efficiency requirement and acts as a deterrent to the use of a spark arrestor.

The disclosed spark arrestor design is the first that has been shown to reach the goal of no change in flow rate, while at the same time meeting the 80% arresting efficiency requirement. In addition, the disclosed design is compact enough to fit inside of existing original equipment manufacturer (OEM) off-highway vehicle exhaust system silencers without adding additional length to the silencer, and also meeting the goal of not increasing sound levels. This compact size characteristic increases marketable value for the design because an aftermarket spark arrestor slip-in for existing OEM silencers may be produced at a much lower cost compared to a completely new silencer system containing a centrifugal type spark arrestor.

Both U.S. Pat. No. 3,407,575 to Krizman (1968) and U.S. Pat. No. 3,009,539 to Papp (1961) disclose centrifugal type spark arrestors but make no claims as to capability of meeting any specific arresting efficiencies, flow rate goals, or size requirements. This prior art does not disclose the novel features of a centrifugal whirling means having an elliptically shaped apex section, compound curvature of fins on two planes, teardrop tail, nor interior shell novel features of both converging and diverging sections with a plurality of passages, or the radiused transition disclosed. It has been demonstrated that the application of these features results in a design which meets the 80% arresting efficiency goal with no change in flow rate. In addition, the compact size of this design has been fit into existing off-highway vehicle silencers and allows for more than sufficient silencing space to meet the 96 decibel requirement.

Papp discloses fin curvature but not compound curvature and curvature in one plane not two which is required to reduce turbulent flow and still provide significant directional velocity for particulate matter to be ejected from the exhaust flow stream. Furthermore, Papp discloses the location of these fins to be on the upstream conical component of the centrifugal whirling means as opposed to the disclosed spark arrestor identifying fin placement after the conical component.

Both Papp and Krizman disclose conical sections to the leading profile of the centrifugal whirling means with the conical sections having open bodies at the rear, this open body design produces significant turbulent flow post whirling means which reduces flow rate & decreases arresting efficiency. By adding a trailing cylinder and closed section tail cone with a teardrop shape the post turbine flow turbulence is significantly reduced so as not to affect flow rate. The bulb tail cone also serves to deflect impacting particulate matter from the exhaust flow stream increasing arresting efficiency.

SUMMARY

A compact slip-in spark arrestor with novel features consisting of: a centrifugal whirling means having an elliptically shaped apex section, compound curvature of fins on two planes, teardrop tail, an interior shell of both converging and diverging sections with a plurality of passages, and the radiused transition disclosed. This novel spark arrestor design is compact enough such that it may be inserted into existing OEM exhaust system silencers without increasing sound output and exhibits performance attributes of a minimum of 80% spark arresting efficiency with no change in exhaust flow rate.

DRAWINGS—FIGURES

FIG. 1 front vertical longitudinal sectional view of a spark arrestor constructed in accordance with the present invention as installed in an existing motorcycle silencer shell.

Figure 2:
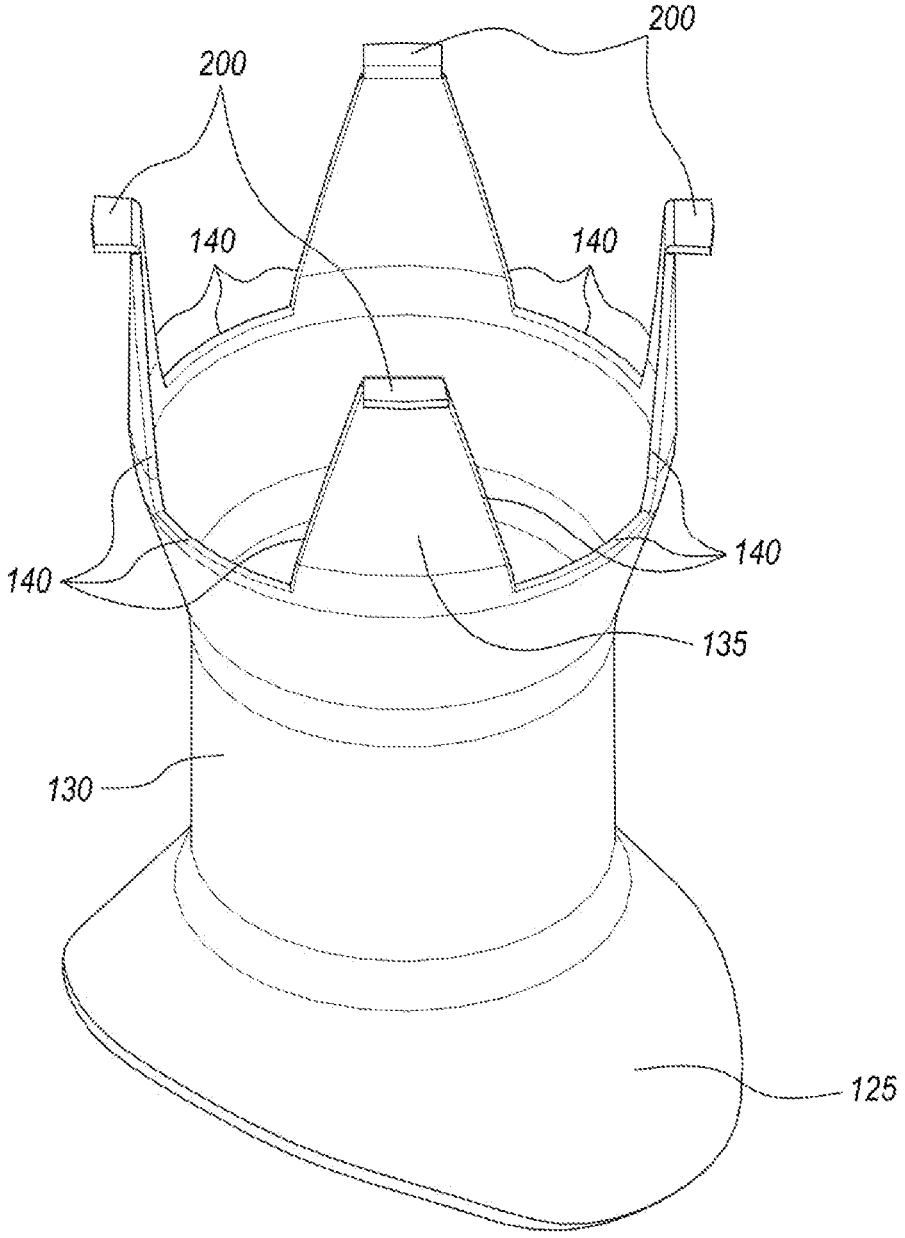

FIG. 2 isometric view of the interior shell.

Figure 3:
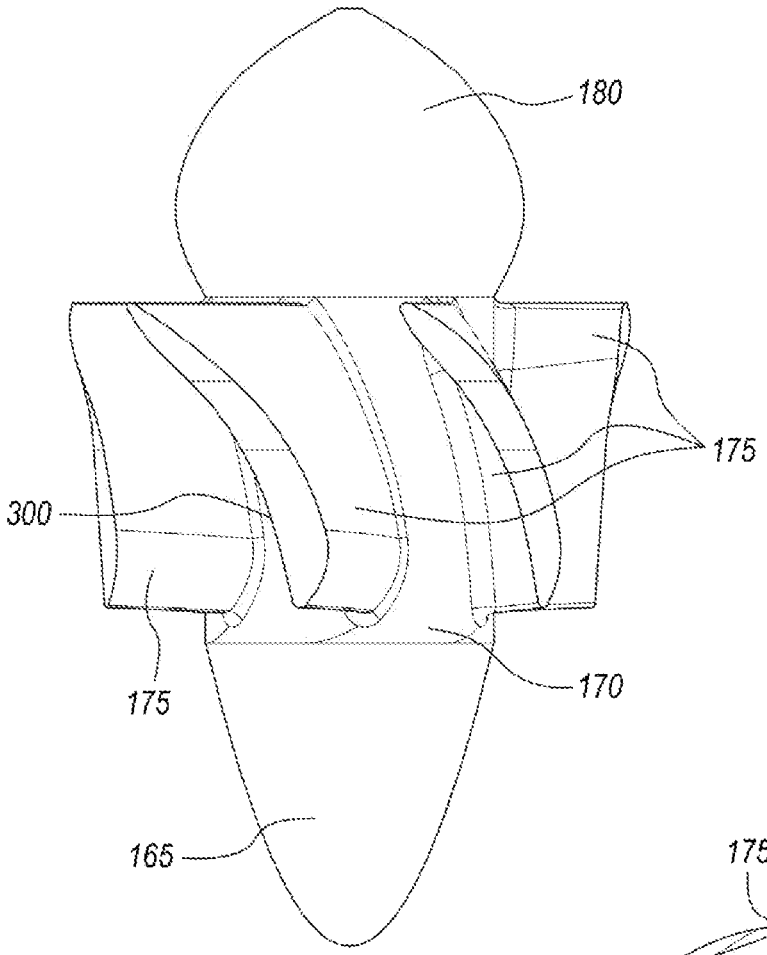

FIG. 3 front view of the centrifugal whirling means.

Figure 3A:
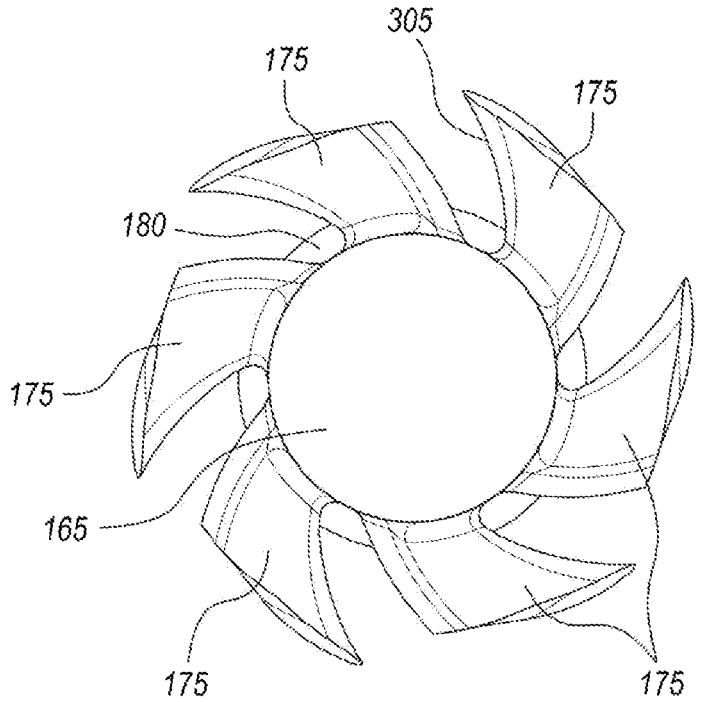

FIG. 3A bottom view of the centrifugal whirling means.

Figure 4:
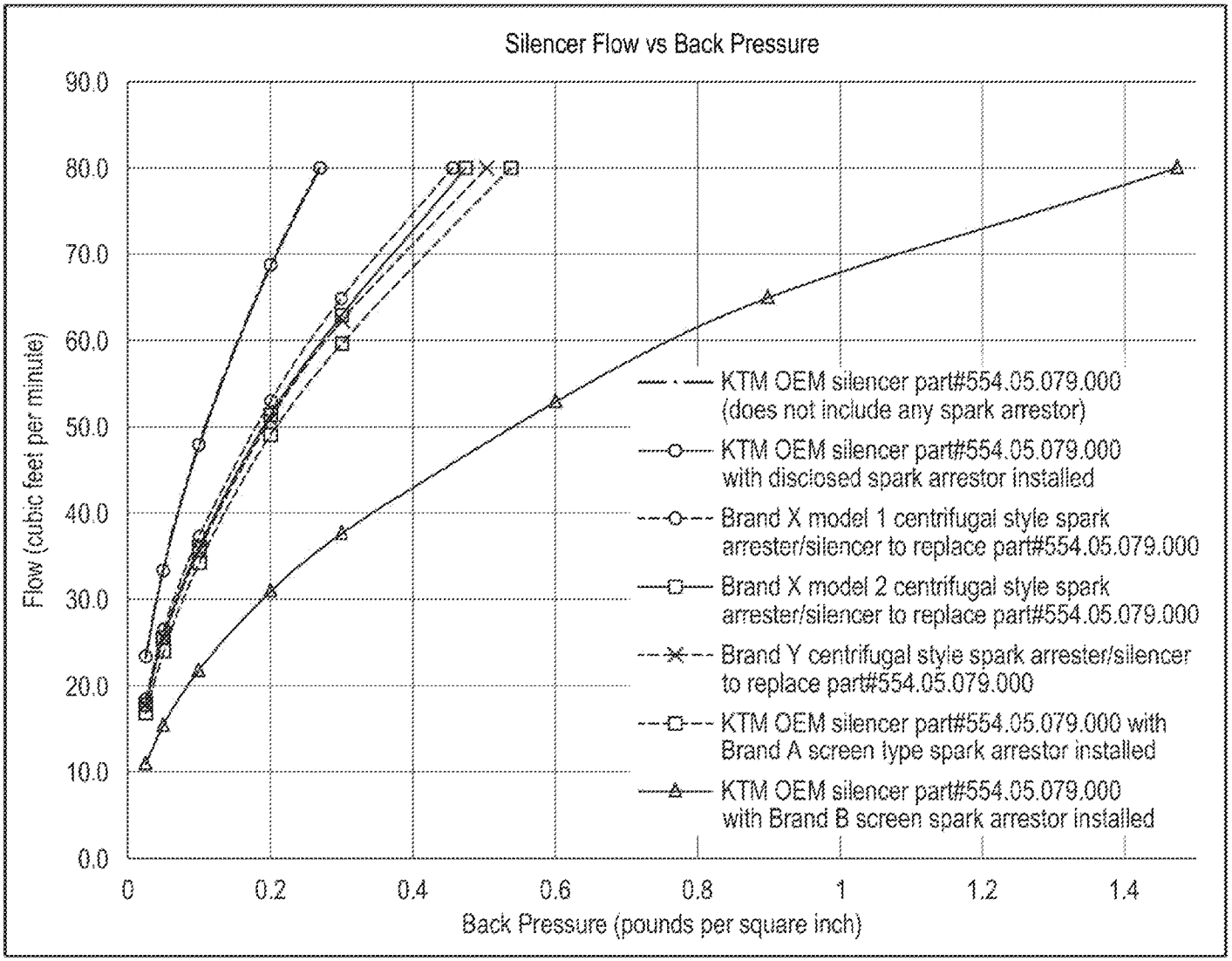

FIG. 4 Flow comparison chart comparing current state of the art spark arrestors to the disclosed spark arrestor.

| Drawings-Reference Numerals |
|---|
| 100 existing silencer shell |
| 105 perforated tube |
| 110 tubular conduit |
| 115 inlet cap member |
| 120 silencer packing |
| 125 interior shell |
| 130 tubular center section |
| 135 second tubular section |
| 140 plurality of passages |
| 145 outlet cap member |
| 150 radiused transition |
| 155 outer chamber |

-continued

| Drawings-Reference Numerals |
|---|
| 160 exterior shell |
| 165 apex section |
| 170 trailing cylinder |
| 175 plurality of fins |
| 180 teardrop tail |
| 185 small aperture |
| 200 tabs |
| 300 first compound curvature |
| 305 second compound curvature |

DETAILED DESCRIPTION—FIGS. 1, 2, 3, 3A

One embodiment of the disclosed spark arrestor is shown in FIG. 1 as it would be fit inside of an existing silencer shell 100 of a motorcycle exhaust system having an elliptical shape. The exhaust flow enters the spark arrestor at the bottom of FIG. 1 through a perforated tube 105 common to motorcycle silencers, and exits through a tubular conduit 110 to the atmosphere at the top of FIG. 1. The perforated tube 105 and entrance to the tubular conduit 110 are aligned axially. An inlet cap member 115 is positioned perpendicular to and in contact with the perforated tube 105 in addition to being in contact with the interior of the existing silencer shell 100 thereby producing a barrier between the silencer packing 120 used in motorcycle silencers, and the spark arrestor.

An interior shell 125 is aligned axially to the perforated tube 105 and exhibits a circular cross-section the diameter of which changes along its axial length. The diameter of the interior shell 125 is at a maximum where it is attached to the inlet cap member 115, this diameter may be truncated at the attachment to the inlet cap member 115 as required by geometrical constraints of the existing silencer shell 100. The diameter of the interior shell 125 subsequently tapers inward in a linear fashion to a radius transition into a tubular center section 130 having a diameter larger than that of the tubular conduit 110, thereafter the diameter continues to a second radius transition before increasing in a linear fashion and reaching a third radius transition into the second tubular section 135 of a diameter intermediate to the tubular center section 130 and maximum observed at the connection to the inlet cap member 115. A plurality of passages 140 are cut out of the second tubular section 135 and third radius transition. The subject embodiment presents 4 of such passages having equivalent shape, size, and equal symmetrical placement about the longitudinal axis of interior shell 125.

The interior shell 125 is also in assembled relation to an outlet cap member 145 by use of tabs 200 visible in FIG. 2. Again referring to FIG. 1, the outer periphery of the entrance to the tubular conduit 110 is joined to the outlet cap member 145 through a radiused transition 150 while an exterior shell 160 contains the tubular conduit 110 and completes an enclosure about it by forming a juncture with the tubular conduit 110 at the atmosphere communicating end and also with the existing silencer shell 100 and outlet cap member 145 creating an outer chamber 155 to the interior shell 125 such that exhaust flow into the atmosphere is constrained to the tubular conduit 110.

Again referencing FIG. 1, a centrifugal whirling means consisting of an apex section 165, a trailing cylinder 170, a plurality of fins 175, and a teardrop tail 180, is fixed in axial alignment with and interior to the interior shell 125 thereby forming an annular passage through which exhaust flow must pass. The apex section 165 is of a general conical shape having the apex oriented such that it is piercing oncoming exhaust flow and henceforth increasing in diameter to a maximum equal to the trailing cylinder 170 and attached thereto. The subject embodiment identifies six fins spaced evenly about the circumference of the trailing cylinder 170, and being contiguous to the interior shell 125 and trailing cylinder 170. Additionally a teardrop tail 180 is attached axially to the trailing cylinder 170 opposite of the apex section 165 having a diameter equal thereto and thereafter progressively increasing before decreasing on approach to the outlet cap member 145 and converging down to a small aperture 185.

Referring to FIG. 3 and FIG. 3A, the plurality of fins 175 of the present embodiment exhibit airfoil shaped surfaces with compound curvatures on two separate planes. In FIG. 3 a first compound curvature 300 is on a plane parallel to the interior shell 125 axis having the characteristics of a curve made up of two or more circular arcs of successively shorter radii, joined tangentially without reversal of curvature, producing an airfoil mean camber line near parallel at leading edge to the interior shell 125 axis thereafter progressively diverging from alignment until reaching a maximum divergence at the rounded trailing edge of said airfoil shape. As shown in FIG. 3A, a second compound curvature 305 in a plane perpendicular to the axis of the interior shell 125 is shown with the second compound curvature 305 having the characteristics of a curve made up of two or more circular arcs of successively longer radii, with respect to proximity to the axis of the trailing cylinder, joined tangentially without reversal.

Operation—FIGS. 1, 2, 3, 3A

Depending on the embodiment the disclosed spark arrestor may be installed interior to the existing silencer shell 100 of an internal combustion engine exhaust system as shown in FIG. 1, or constructed as an original integral internal component to a new silencer for an internal combustion engine exhaust system.

In function, as exhaust flow enters the spark arrestor shown in FIG. 1 through the perforated tube 105 and into the interior shell 125, the relatively large initial cross-sectional area therein compared to the perforated tube 105, serves to reduce the exhaust flow velocity and turbulence as the exhaust flow is re-directed into the annular passage created by the apex section 165 and tubular center section 130. As the exhaust flow enters the annular passage at the tubular center section 130 the cross-sectional area available for exhaust flow is reduced thereby increasing the exhaust flow velocity, also acting on the exhaust flow in this area are the plurality of fins 175 re-directing the flow into a whirling motion and imparting centrifugal force on the exhaust flow and particulate matter contained therein. The previously disclosed airfoil shape and compound curvature of the plurality of fins 175 are designed such that the typical turbulent flow region caused by the leading edge and body of straight flat fins of prior art is all but eliminated in this region, providing a reduction in back pressure compared to prior art. As the whirling exhaust flow exits the tubular center section 130, centrifugal force acts on particulate matter in the exhaust flow forcing it to the outside perimeter of the interior shell 125 where it passes through one of the plurality of passages 140 and is captured in the outer chamber 155. Additional particulate matter capture mechanisms include deflection of particulate matter off of the teardrop tail 180 or the radiused transition 150 of the outlet cap member 145 before entering one of the plurality of passages 140 and being removed from exhaust flow. The disclosed teardrop tail 180 also provides a tapering surface leading into the tubular conduit 110 that supports non-disrupted exhaust flow reducing back pressure and maintaining exhaust flow rate. The small aperture 185 in the teardrop tail 180 allows escape of pressure internal to the centrifugal whirling means if a brazing or welding construction method is used and also during normal operation as hot exhaust flow increases the internal temperature of the centrifugal whirling means. The curved nature of the tubular conduit 110 is common for motorcycle silencers for the purpose of exhaust flow noise attenuation and to prevent entrance of foreign matter when the exhaust flow is not present. The curvature may be adjusted depending on the spark arrestor mounting orientation for both of these purposes.

Example 1—FIG. 4

FIG. 4 summarizes flow testing performed on multiple aftermarket brands and models of new state of the art silencer systems that included integral centrifugal spark arrestors designed to replace the OEM silencer of 2017 KTM 250SX two-stroke motorcycles (KTM OEM part #554.05.079.000). Flow testing was also performed on the OEM non-spark arrested silencer (KTM OEM part #554.05.079.000) in addition to testing on the OEM silencer with 2 different screen type spark arrestors installed as well as the disclosed spark arrestor installed. The flow testing apparatus consisted of A LAMB brand blower used to generate airflow, a Pitot tube to capture dynamic pressure, and a port in the ducting for static pressure. Both pressures were measured using the same digital manometers and ducting diameter feeding the silencers was controlled in size to allow standard flow calculations using Bernoulli's equation. The flow rate range tested covers that which the subject engine would produce, 0-80 Cubic feet per minute (CFM), under normal operating conditions. All testing was performed under the same ambient conditions on the same day. As shown in FIG. 4 the disclosed spark arrestor installed into the OEM silencer produced the same flow rate for all given back pressure conditions compared to the OEM silencer without a spark arrestor. By comparison, all of the other spark arrestors tested produced moderate to severe reductions in flow rate at the subject back pressures compared to the OEM silencer without a spark arrestor.

Example 2—Table I

The arresting efficiency of the disclosed spark arrestor installed in an existing silencer shell (KTM OEM part #554.05.079.000) was tested by the USFS San Dimas laboratory and passed testing with an arresting efficiency of 80% or greater. Table I summarizes said test results.

TABLE I

| Run | Flow rate (CFM) | Carbon size SAE J997 | Back pressure (psi) | Arresting efficiency (%) |
|---|---|---|---|---|
| 1 | 125 | Large | 0.99 | 87.21 |
| 2 | 125 | Small | 0.99 | 87.75 |
| 3 | 94 | Large | 0.78 | 82.38 |
| 4 | 94 | Small | 0.68 | 81.35 |
| 5 | 69 | Large | 0.28 | 89.91 |
| 6 | 69 | Small | 0.28 | 86.56 |
| 7 | 41 | Large | 0.5 | 84.35 |
| 8 | 41 | Small | 0.12 | 87.82 |

TABLE I-continued

| Run | Flow rate (CFM) | Carbon size SAE J997 | Back pressure (psi) | Arresting efficiency (%) |
|---|---|---|---|---|
| 9 | 13 | Large | 0.01 | N/A |
| 10 | 13 | Small | 0.02 | N/A |

I claim:

1. A spark arrestor capable of fitting into an interior of an existing silencer shell of an internal combustion engine exhaust system, comprising:

an interior shell attached to an inlet cap member and an outlet cap member with said interior shell comprising a tubular center section located therebetween and said inlet cap member and said outlet cap member having passage diameters axial to and smaller in diameter compared to said tubular center section and said interior shell having a circular cross-section changing in diameter along the axial length between said inlet and outlet cap members with the largest of said diameter at said inlet cap member thereafter tapering down to the smallest of said diameter at said tubular center section before said diameter increases reaching a final diameter intermediate to said smallest and said largest and remaining constant thereby forming a second tubular section thereto having a plurality of passages cut into said second tubular section and said inlet cap member periphery fitting interior to said existing silencer shell thereby constraining exhaust flow into said spark arrestor to the passage diameter of said inlet and;

an exterior shell containing a tubular conduit fixed in said passage diameter of said outlet cap member and communicating there between the atmosphere, said exterior shell forming a juncture with said tubular conduit at the atmosphere communicating end and also with said existing silencer shell and said outlet cap member thereby creating an enclosure about said tubular conduit, and also completing an outer chamber to said interior shell such that exhaust flow out of said spark arrestor and into the atmosphere is constrained to said tubular conduit;

means axially disposed in said center section for reducing cross-sectional area thereof, for creating a whirling of said exhaust flow, and for deflecting any particulate matter out of said exhaust flow and through said plurality of passages into said outer chamber, said means including an apex section attached to a trailing cylinder oriented such that said cross-sectional area is gradually reduced with respect to said exhaust flow direction and thereby forming an annular passage where said exhaust flow is accelerated due to the reduced cross-sectional area, said means including a plurality of fins radially spaced in said annular passage and transversely oriented to said exhaust flow to impart said whirling thereby centrifugally accelerating said exhaust flow and any particulate matter suspended therein to the interior periphery of said interior shell wherein said particulate matter is removed from said exhaust flow as it passes through said plurality of passages and into said outer chamber.

2. The spark arrestor as defined in claims 1 wherein the length of said spark arrestor from said inlet cap member to said outlet cap member is less than 4 times the passage diameter of said inlet cap member.

3. The spark arrestor as defined in claim 1 wherein the profile of said apex section is elliptical.

4. The spark arrestor as defined in claim 1 wherein said means includes a teardrop tail attached axially to said trailing cylinder opposite of said apex section having a diameter equal thereto and thereafter progressively increasing before decreasing on approach to said outlet cap member thereby producing a deflecting surface transversely oriented to said exhaust flow whereby said particulate material from said exhaust flow impacting said deflecting surface is redirected into said plurality of passages and said outer chamber outside of said exhaust flow.

5. The spark arrestor as defined in claim 1 wherein said plurality of fins exhibit airfoil shaped surfaces with curvature including a first compound curvature in a plane parallel to the axis of said trailing cylinder, said first compound curvature having the characteristics of a curve made up of two or more circular arcs of successively shorter radii, joined tangentially without reversal of curvature thereby producing an airfoil mean camber line near parallel at said fins leading edge to said annular passage thereafter progressively diverging from alignment to said annular passage until reaching a maximum divergence at the rounded trailing edge of said airfoil shape.

6. The spark arrestor as defined in claim 1 wherein said plurality of fins exhibit airfoil shaped surfaces with curvature including a second compound curvature in a plane perpendicular to the axis of said trailing cylinder, said second compound curvature having the characteristics of a curve made up of two or more circular arcs of successively longer radii, with respect to proximity to the axis of said trailing cylinder, joined tangentially without reversal.

7. The spark arrestor as defined in claim 1 wherein a radiused transition exists between the outer periphery of said tubular conduit and said outlet cap member at or near said an exhaust flow entrance to said tubular conduit.

8. The spark arrestor as defined in claim 1 wherein removal of said particulate matter from said exhaust flow of said internal combustion engine exhaust system is performed with a minimum of 80% efficiency.

9. The spark arrestor as defined in claim 1 wherein installation of said spark arrestor into said internal combustion engine exhaust system does not change the exhaust flow rate at any operational back pressure compared to the exhaust flow rate prior to installation.

10. A silencer for an internal combustion engine exhaust system comprising an exterior shell and the spark arrestor of claim 1.

* * * * *